US007370389B2

(12) United States Patent
Tsen

(10) Patent No.: US 7,370,389 B2
(45) Date of Patent: May 13, 2008

(54) WATER FILTER VACUUM CLEANER

(76) Inventor: Samson Tsen, No. 8, Lane 249, Lung-Chiang Rd., Chung-Shan Dist., Taipei City (TW)

( * ) Notice: Subject to any disclaimer, the term of this patent is extended or adjusted under 35 U.S.C. 154(b) by 716 days.

(21) Appl. No.: 10/995,161

(22) Filed: Nov. 24, 2004

(65) Prior Publication Data

US 2006/0107487 A1 May 25, 2006

(51) Int. Cl.
*A47L 9/10* (2006.01)

(52) U.S. Cl. ..... 15/353; 15/352

(58) Field of Classification Search ..... 15/352, 15/353

See application file for complete search history.

(56) References Cited

U.S. PATENT DOCUMENTS 7,251,855 B2 * 8/2007 Hayashi et al. ..... 15/353

* cited by examiner

*Primary Examiner*—Joseph J. Hail, III
*Assistant Examiner*—Shantese L McDonald
(74) *Attorney, Agent, or Firm*—Muncy, Geissler, Olds & Lowe, PLLC

(57) ABSTRACT

An improved water filter vacuum cleaner includes a vacuum body which contains a dust chamber and a dust collector assembly in the dust chamber that contains filter water. The dust collection assembly includes a dust collection seat and an upper cap. The dust collection seat is divided by a partition to form a filter chamber and an airflow chamber that communicate with each other. The airflow chamber has an airflow duct connecting to the filter chamber. The vacuum body has a suction assembly to generate a suction airflow which sucks suction articles through the airflow duct into the filter chamber. The suction airflow generates oscillating moisture to trap the suction articles. The cleaned suction airflow passes through the upper cap and a guiding member communicating with the upper cap to the suction assembly to form output airflow in the suction assembly to be discharged through an air outlet.

11 Claims, 9 Drawing Sheets

WATER FILTER VACUUM CLEANER

FIELD OF THE INVENTION

The present invention relates to an improved water filter vacuum cleaner and particularly to a water filter vacuum cleaner for drawing external suction articles and trapping the suction articles and collecting dusts through internal oscillation moisture generated a suction airflow.

BACKGROUND OF THE INVENTION

Nowadays the vacuum cleaner has almost become an indispensable household cleaning appliance. It generally includes a vacuum body to generate a strong suction airflow and a housing compartment in the vacuum body. The vacuum body is connected to a hollow hose which has a distal end connecting to a suction head. When the suction body generates the suction airflow, suction articles are drawn through the suction head and the hose into the housing compartment. After vacuum operation has been finished, the housing compartment may be detached from the vacuum body for clearing the suction articles drawn inside.

The present vacuum cleaners can be divided into a dry vacuum cleaner and a wet vacuum cleaner. Both are designed to generate a strong suction airflow. Due to the strong airflow, the conventional dry vacuum cleaner often cannot trap small articles (such as fine dusts or debris) in the housing compartment. The fine dusts are dispelled with the discharged airflow to the exterior. Dust collecting function becomes not effective. Referring to FIG. 1, the wet vacuum cleaner differs from the dry vacuum cleaner in the design of the housing compartment. As shown in the drawing, the housing compartment contains filter water. And an airflow duct is extended from interior of the housing compartment to couple with a connection tube. When the suction articles are drawn into the housing compartment, the suction airflow generates oscillating water spray in the housing compartment to bind and trap the suction articles. The rest clean air is discharged outside. Hence it is more effective than the dry vacuum cleaner and can overcome the disadvantage of failing to trap the small suction articles occurred to the dry vacuum cleaner.

However, as shown in FIG. 1, the conventional wet vacuum cleaner that provides water filter function mostly is quite bulky. This is because the housing compartment has only one filer room. When the contained water is not enough, suction airflow tends to splash the water excessively and result in not desirable binding with the suction articles. Although some vacuum cleaners have a partition located in the housing compartment, the partition merely aims to prevent the water from being dispelled with the discharged airflow and causing dysfunction of the vacuum cleaner. If the water content is too much, the filter room is too large and oscillating water spray cannot be generated as desired, and the strong suction airflow tends to carry a portion of the filter water away outside the housing compartment. As a result, the filter water splashes outside and causes environmental pollution. And an extra effort is needed to wipe the spilled water. It is troublesome.

SUMMARY OF THE INVENTION

Therefore the primary object of the present invention is to solve the aforesaid disadvantages. The present invention employs a converged filter approach to generate oscillating moisture and trap suction articles. It includes a vacuum body which contains a dust chamber and a dust collection assembly in the dust chamber that contains filter water. The dust collection assembly consists of a dust collection seat and a upper cap. The interior of the dust collection seat is divided by a partition into a filter chamber and an airflow chamber that communicate with each other. The airflow chamber has an airflow duct connecting to the filter chamber. The vacuum body has a suction assembly to generate a suction airflow to draw suction articles into the filter chamber through the airflow duct, and the suction airflow also generates oscillation moisture to trap the suction articles. Then the clean suction airflow is discharged through the upper cap and a guiding member communicating with the upper cap and the suction assembly to the suction assembly to form an output airflow to be discharged through an air outlet. Such a structure can effectively filter the suction articles and shrink the size of the water filter vacuum cleaner.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
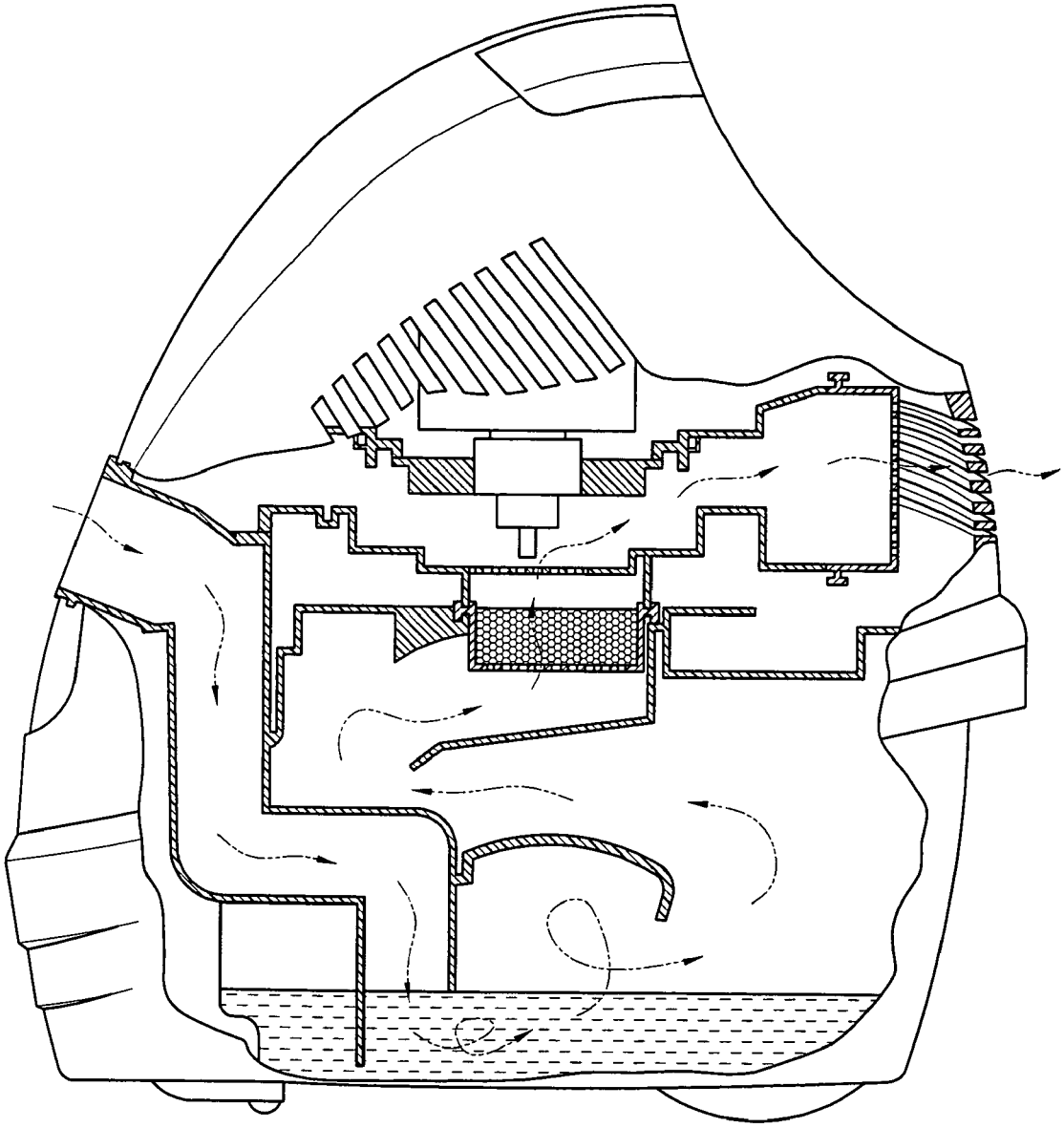
Fig.1 PRIOR ART
FIG. 1 is a schematic view of a conventional wet vacuum cleaner.
Figure 2:
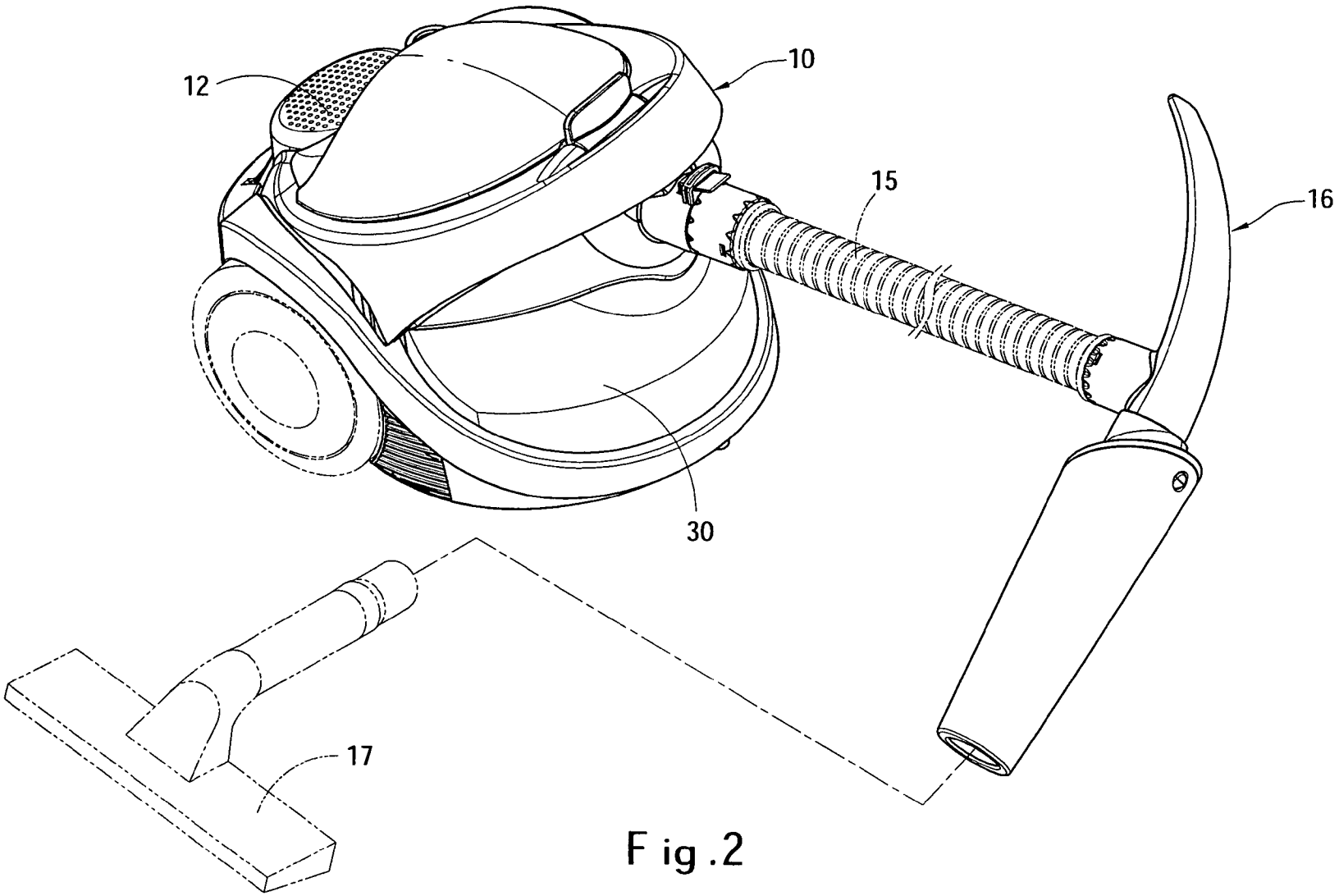
FIG. 2 is a perspective view of the present invention.
Figure 3:
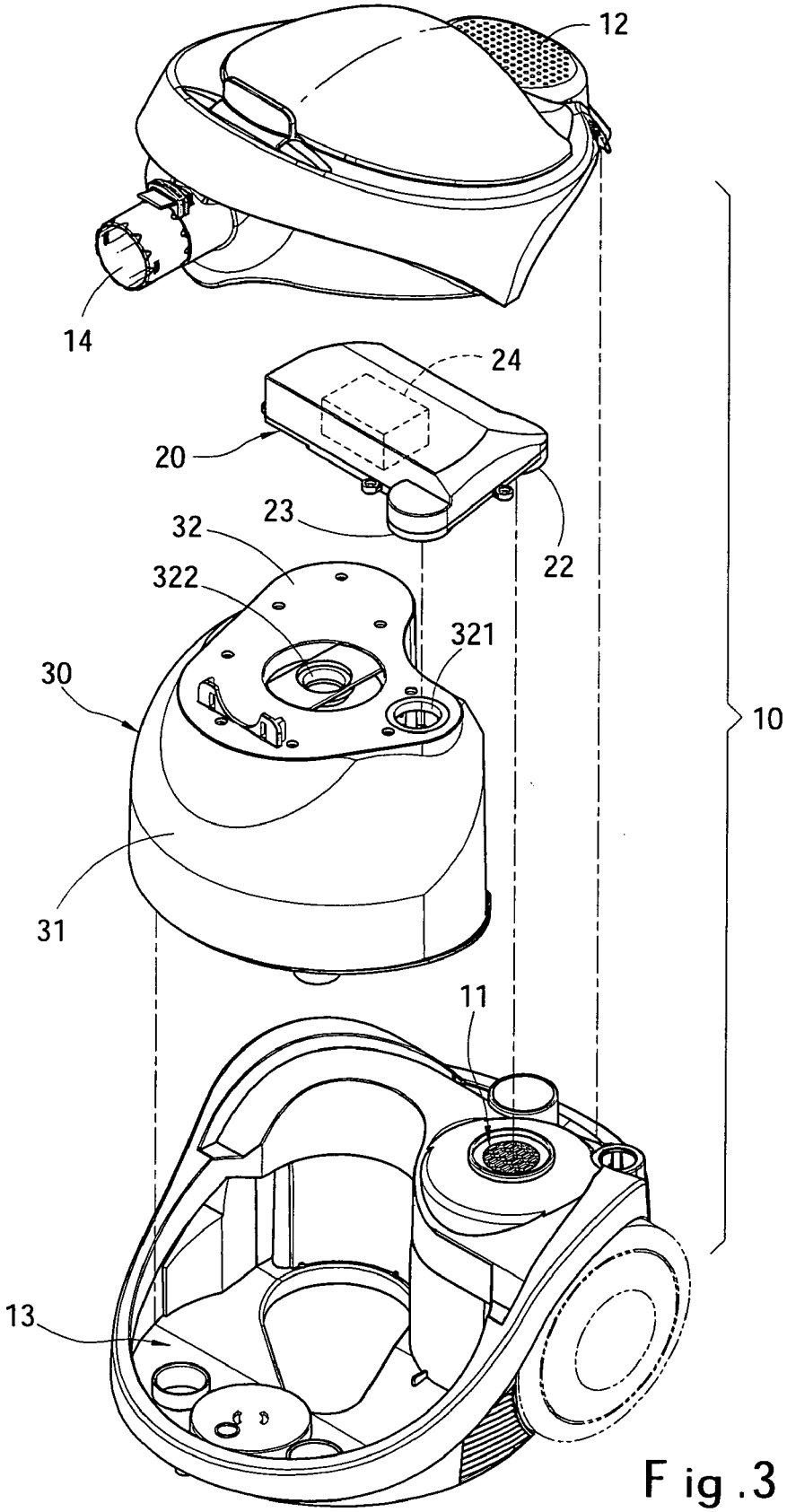
FIG. 3 is an exploded view of the vacuum body of the present invention.
Figure 6:
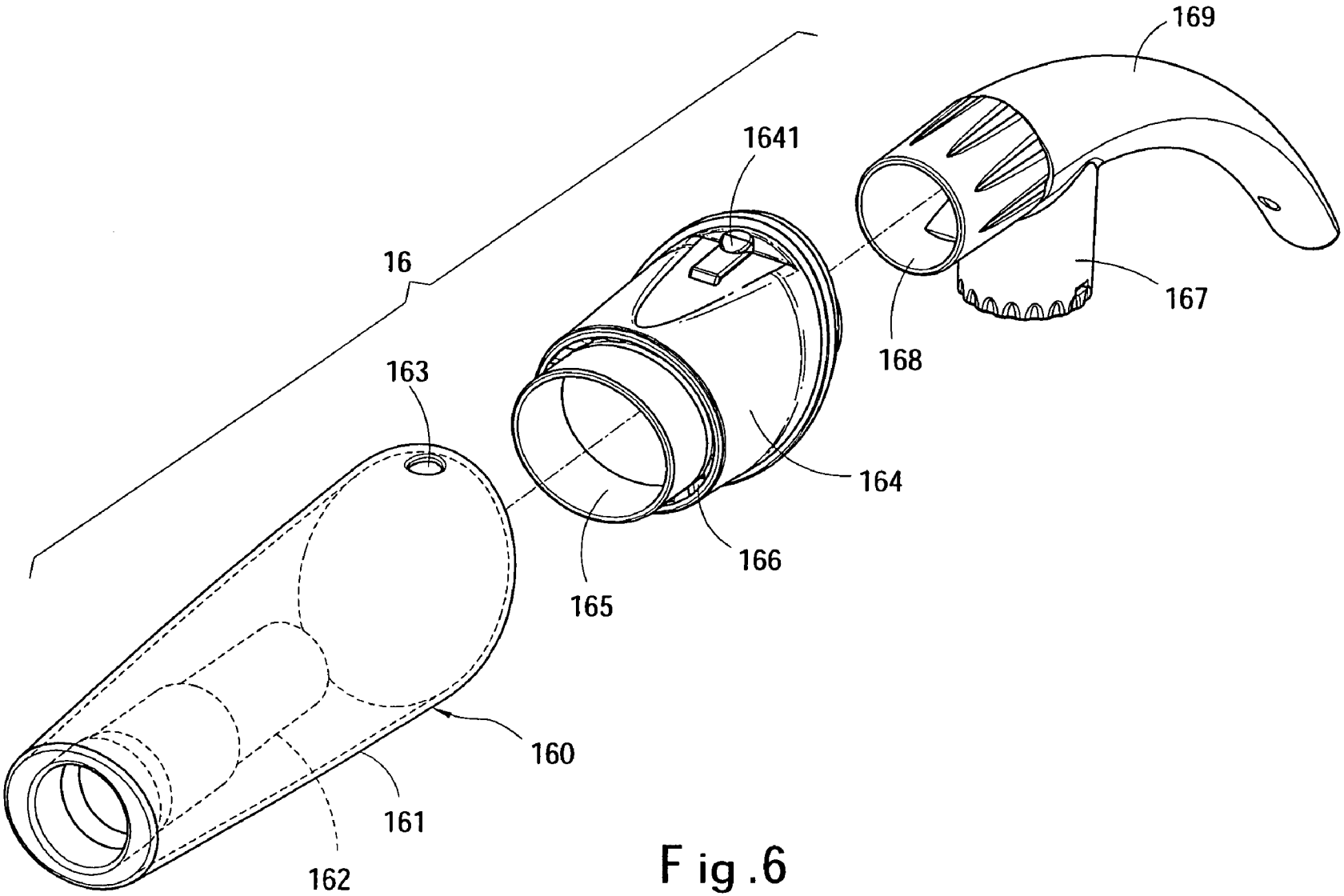
FIG. 6 is an exploded view of the dust collector of the present invention.

Please referring to FIGS. 2 and 3, the water filter wet vacuum cleaner according to the present invention includes a vacuum body 10 which is openable. The vacuum body 10 includes a suction assembly 11 capable of generating a suction airflow and an output airflow and an air outlet 12 communicating with the suction assembly 11 to discharge the output airflow. The suction assembly 11 includes a motor and fan like a conventional technique. The vacuum body 10 has a dust chamber 13 in the interior and a suction port 14 communicating with the dust chamber 13 and connecting to an external suction means. Referring to FIG. 6, the external suction means includes a hose 15 connecting to the suction port 14 and a suction head 17 connecting to other end of the hose 15. The hose 15 is connected to a dust collector 16. The dust collector 16 includes a housing chamber 161 made from a transparent or translucent material, a suction duct 162, a housing seat 160 connecting to the suction head 17, a barrier section 165 and a coupling hub 164 of a suction bore 166 that connect to the housing seat 160 corresponding to the suction duct 162, and a base dock 167 connecting to the coupling hub 164 that has an airflow passage 168. The housing seat 160 and the coupling hub 164 have respectively a fastening bore 163 and a latch section 1641 that mate each other. The base dock 167 further has a handle 169 for user grasping during vacuuming.

Figure 4:
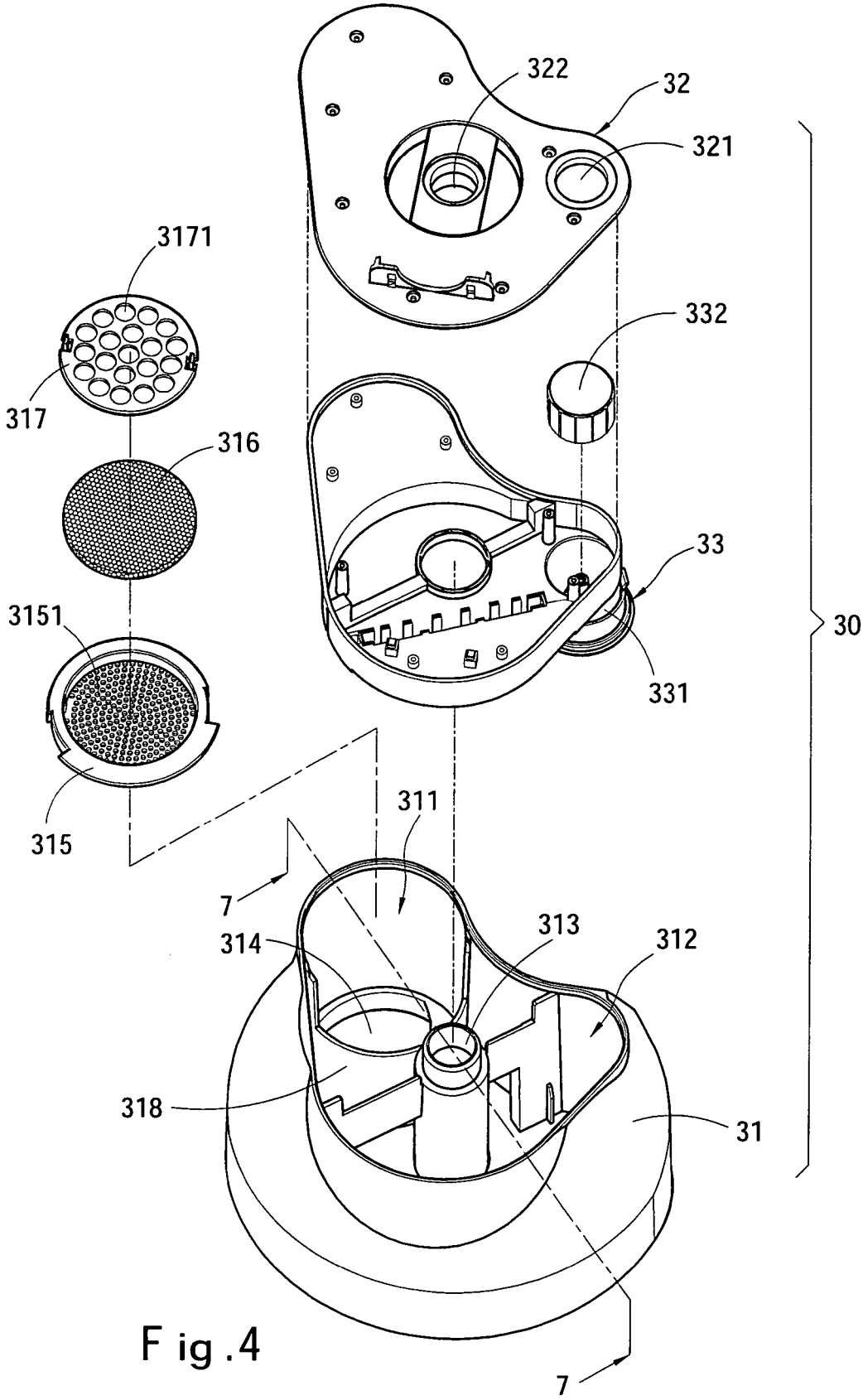
FIGS. 4 and 5 are exploded views of the dust collection assembly of the present invention.
Figure 5:
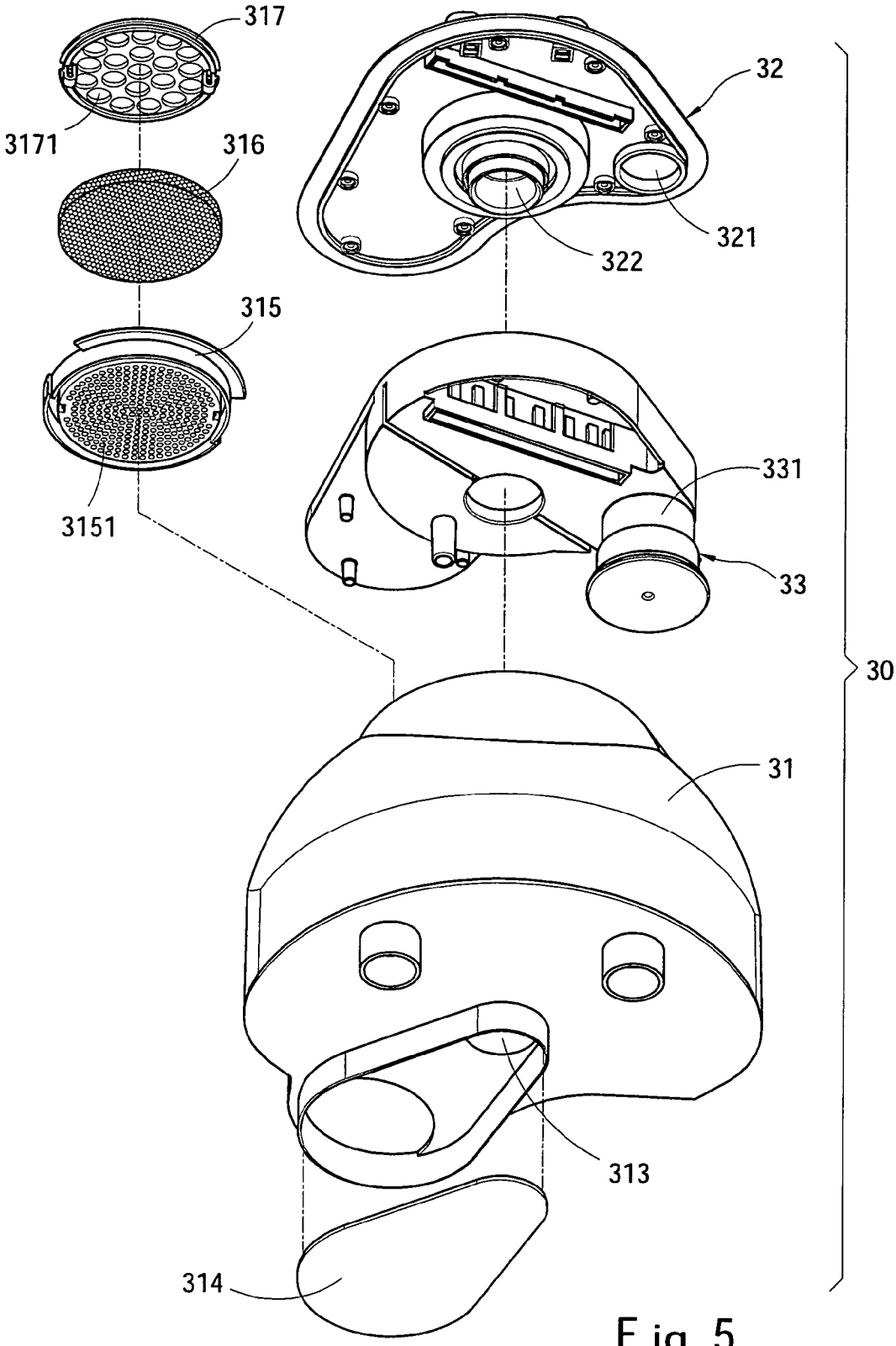
Figure 7:
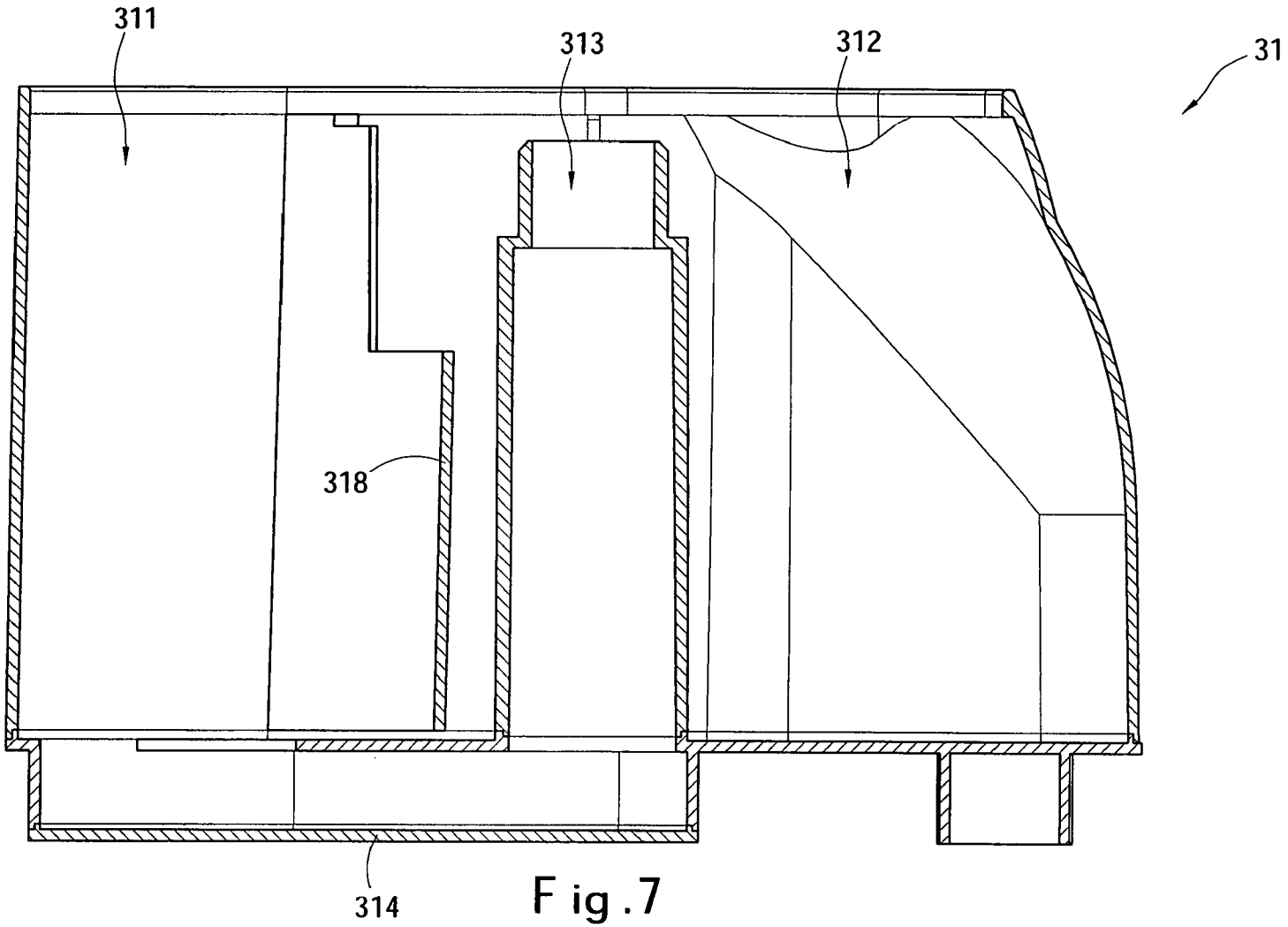
FIG. 7 is a cross section taken on line 7-7 in FIG. 4.

Referring to FIGS. 4 and 5, in the dust chamber 13 there are a guiding member 20 and a dust collection assembly 30. The guiding member 20 has a first air passage which includes a first airflow port 22 on one end connecting to the suction assembly 11 and a second airflow port 23 on another end. The guiding member 20 further has a filter 24 in the first airflow passage between the first airflow port 22 and the second airflow port 23. The duct collection assembly 30 includes a duct collection seat 31 for holding filter water and a upper cap 32 coupling on the duct collection seat 31. The upper cap 32 consists of two corresponding half boxes that are coupled together. The upper cap 32 further has a second airflow passage which has a third airflow port 321 on one end connecting to the second airflow port 23 and a fourth airflow port 322 connecting to the suction port 14. The dust collection seat 31 is divided into a filter chamber 311 and an airflow chamber 312 by a partition 318. The airflow chamber 312 has a hollow air duct 313 which has one end connecting to the fourth airflow port 322 and another end communicating with the filter chamber 311. Referring to FIG. 7, The airflow duct 313 and the filter chamber 311 are communicated through an airflow seat 314. The filter chamber 311 contains a filter assembly which consists of a base 315 which has filter pores 3151, a filter mesh 316 located on the base 315 and a lid 317 containing air vents 3171 to cover the base 315. The upper cap 32 further includes a guarding member 33 on the third airflow port 321 that has a hollow housing 331 to hold an inhibitor 332 to serve as a counter weight to close the third airflow port 321. The guarding member 33 aims to close the third airflow port 321 through the inhibitor 332 lifted by the suction of the suction airflow when the water in the filter chamber 311 exceeds the upper limit and the suction airflow cannot generate desired oscillation moisture to form a smooth airflow. Then users are alerted to close immediately to prevent the water from being discharged with the airflow caused by excessive suction airflow that occurred to the conventional wet vacuum cleaner.

Figure 8:
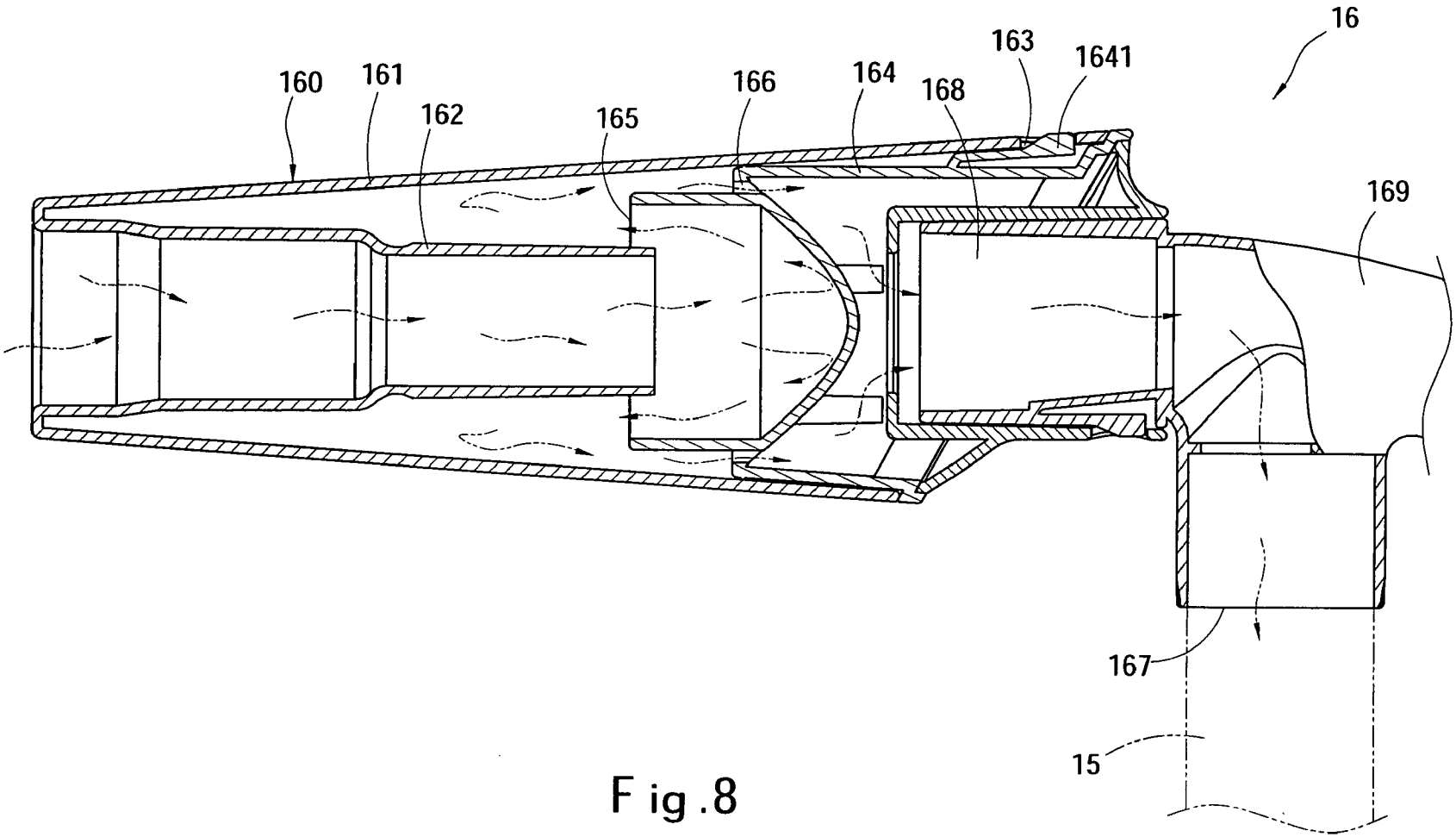
FIG. 8 is a schematic view of the airflow direction in the duct collector of the present invention.

Referring to FIG. 8, when the suction assembly 11 of the vacuum body 10 generates a suction airflow, and suction articles are sucked in through the suction head 17 into the dust collector 16, the barrier section 165 in the dust collector 16 blocks larger suction articles so that they drop into the housing chamber 161, while the smaller suction articles are drawn through the suction bore 166, airflow passage 168 and hose 15 into the vacuum body 10. The dust collector 16 of the invention aims to prevent the larger suction articles from entering the vacuum body 10 that might cause clogging. It also makes clearing of the larger suction articles such as small screws, small nails, thumbtacks or glass debris easier.

Figure 9:
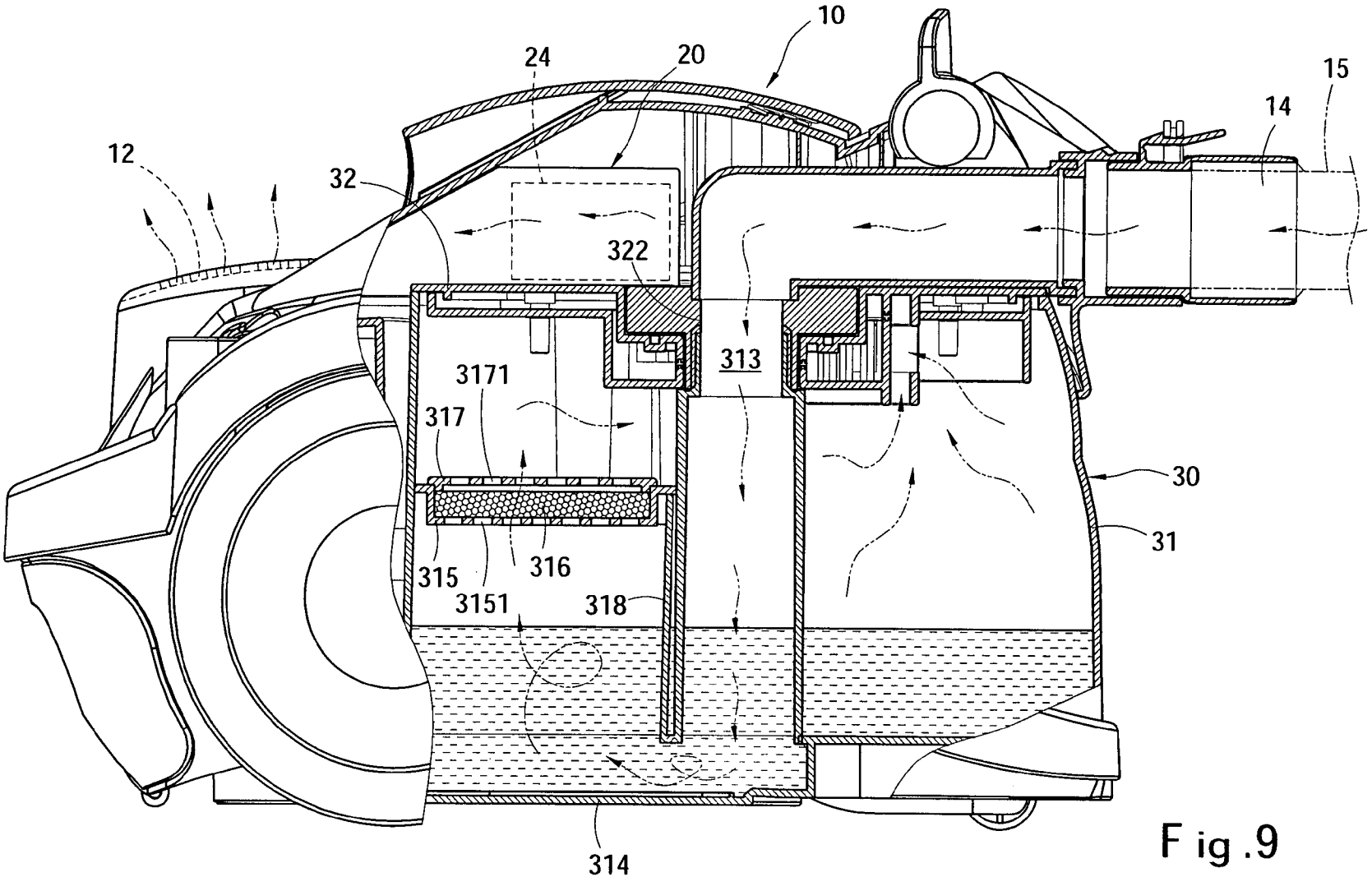
FIG. 9 is a schematic view of the airflow direction in the vacuum body of the present invention.

Referring to FIG. 9, when the suction articles enter the dust collection assembly 30 through the suction port 14, as the suction airflow has already generated oscillating moisture in the filter chamber 311, the airflow duct 313 and the airflow seat 314 also have oscillating moisture, so that small suction articles such as dusts are bond to the oscillating moisture in the airflow duct 313, airflow seat 314 and filter chamber 311 and trapped. If there is a small amount of the suction articles that do not bind to the oscillating moisture, they are filtered by the filter and also are trapped. Hence the clean suction air passes from the airflow chamber 312 through the third airflow port 321 to the second airflow port 23 and enters the first airflow passage. Meanwhile, the filter 24 in the guiding member 20 further filters the air so that the air passing through the first air passage and the first airflow port 22 and the suction assembly 11 becomes the clean output airflow to be discharged through the air outlet 12.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. An improved water filter vacuum cleaner, comprising:

a vacuum body having a suction assembly to generate a suction airflow and an output airflow, an air outlet connecting to the suction assembly to discharge the output airflow, a dust chamber formed therein, and a suction port communicating with the dust chamber and connecting to an external suction means;

a guiding member having a first airflow passage which has a first airflow port on one end connecting to the suction assembly and a second airflow port on other end; and a dust collection assembly located in the dust chamber including a hollow dust collection seat for holding filter water and a upper cap, the upper cap having a second airflow passage which has a third airflow port on one end connecting to the second airflow port and a fourth airflow port on other end connecting to the suction port, the dust collection seat being divided by a partition to form a filter chamber and an airflow chamber that communicate with each other, the airflow chamber having a hollow airflow duct which has one end connecting to the fourth airflow port and other end communicating with the filter chamber;

wherein the suction assembly generates a suction airflow to allow the external suction means to suck suction articles from the suction port to pass through the fourth airflow port and the airflow duct into the filter chamber and to generate oscillating moisture in the filter chamber to trap the suction articles thereby cleaned suction airflow flowing through the third airflow port, the second airflow port and the first airflow port to the suction assembly to form the output airflow to be discharged through the air outlet.

2. The improved water filter vacuum cleaner of claim 1, wherein the first airflow passage of the guiding member has a filter.

3. The improved water filter vacuum cleaner of claim 1, wherein the filter chamber includes a filter assembly.

4. The improved water filter vacuum cleaner of claim 3, wherein the filter assembly includes a base which has filter pores, a filter mesh located on the base and a lid containing air vents to cover the base.

5. The improved water filter vacuum cleaner of claim 1, wherein the upper cap has a guarding member in the third airflow port, the guarding member having a hollow housing for holding an inhibitor to close the third airflow port.

6. The improved water filter vacuum cleaner of claim 1, wherein the airflow duct and the filter chamber are communicated through an airflow seat.

7. The improved water filter vacuum cleaner of claim 1, wherein the external suction means includes a hose connecting to the suction port and a suction head connecting to other end of the hose.

8. The improved water filter vacuum cleaner of claim 7, wherein the hose is coupled with a duct collector which has a housing seat containing a housing chamber and a suction duct, a barrier section and a coupling hub of a suction bore that connect to the housing seat corresponding to the suction duct, and a base dock connecting to the coupling hub that has an airflow passage.

9. The improved water filter vacuum cleaner of claim 8, wherein the base dock has a handle.

10. The improved water filter vacuum cleaner of claim 8, wherein the housing seat is connected to the suction head.

11. The improved water filter vacuum cleaner of claim 8, wherein the housing seat and the coupling hub have respectively a fastening bore and a latch section mating each other.

* * * * *